US006995850B2

(12) United States Patent
Chuang

(10) Patent No.: US 6,995,850 B2
(45) Date of Patent: Feb. 7, 2006

(54) MONITORING APPARATUS FOR POLISHING PAD AND METHOD THEREOF

(75) Inventor: Szu-Yuan Chuang, Tainan (TW)

(73) Assignee: Vanguard International Semiconductor Corporation, Hsinchu (TW)

( * ) Notice: Subject to any disclaimer, the term of this patent is extended or adjusted under 35 U.S.C. 154(b) by 379 days.

(21) Appl. No.: 10/327,000

(22) Filed: Dec. 24, 2002

(65) Prior Publication Data

US 2003/0123067 A1 Jul. 3, 2003

(30) Foreign Application Priority Data

Dec. 27, 2001 (TW) ..... 90132613 A

(51) Int. Cl.
*G01B 11/28* (2006.01)

(52) U.S. Cl. ..... 356/630; 356/622

(58) Field of Classification Search ..... 356/630, 356/614, 622

See application file for complete search history.

(56) References Cited

U.S. PATENT DOCUMENTS 6,075,606 A * 6/2000 Doan ..... 356/630

FOREIGN PATENT DOCUMENTS

| | | |
|---|---|---|
| TW | 384394 | 3/2000 |
| TW | 466153 | 12/2001 |

* cited by examiner

*Primary Examiner*—Gregory J. Toatley, Jr.
*Assistant Examiner*—Roy M. Punnoose
(74) *Attorney, Agent, or Firm*—Birch, Stewart, Kolasch & Birch, LLP

(57) ABSTRACT

A monitoring apparatus for a polishing pad. A chemical mechanical polishing machine, a polishing pad, a measuring device, and a display device are provided. The polishing pad is situated in a predetermined position in the chemical mechanical polishing machine. The measuring device is coupled to the chemical mechanical polishing machine to measure the thickness of the polishing pad. The measured thickness of the polishing pad is displayed on the display device.

5 Claims, 4 Drawing Sheets

MONITORING APPARATUS FOR POLISHING PAD AND METHOD THEREOF

BACKGROUND OF THE INVENTION

1. Field of the Invention

The present invention relates to a device for monitoring a polishing pad and a method thereof. More particularly, it relates to an apparatus and a method for measuring the polishing pad to determine the need for replacement.

2. Description of the Related Art

Chemical mechanical polishing (CMP) process is a method for flattening a surface of a substrate by polishing pad and abrasive slurry.

The substrate is set on a rotatable carrier head and is contacted by a rotating polishing pad having a coarse surface.

The abrasive slurry is sprayed on the polishing pad, preceding a chemical or mechanical reaction with the substrate.

The surface of the portion polishing pad becomes glazed after a certain period of use. The glazed surface of the polishing pad can damage the wafer, so the polishing pad is conditioned to deglaze the surface thereof. The polishing pad is exchanged after a certain number of polishings, such as 300–500.

A conventional chemical mechanical polishing machine is shown in FIG. 1*a*. The chemical mechanical polishing machine comprises a polishing spindle 101, a platen 102, a slurry supply unit 103, a polishing carrier 104, a polishing pad 105, all acting on a wafer 106. The polishing carrier 104 is disposed on the polishing spindle 101. The polishing pad 105 is disposed on the platen 102. The wafer 106 is held by the polishing carrier 104.

After a certain period of time of polishing or a certain number of polishings, the pad is conditioned to restore its uniformity, or, if beyond repair, replaced.

There is currently no way to quickly determine if replacement of the polishing pad is required. The polishing pad 105 as shown in FIG. 1*a* is removed from the platen and viscose (not shown) is removed therefrom. Thickness of the polishing pad from the edge to the center of the polishing pad is measured, generating a thickness profile as shown in FIG. 1*b*. The polishing pad is replaced when the thickness of the polishing pad is not uniform as shown in FIG. 1*b*.

A conventional polishing pad 201 is shown in FIGS. 2*a*–2*b*. The polishing pad 201 is hollow, and gaps 202 and 203 form on the inner wall and outer wall of the polishing pad 201 respectively. The thickness of the polishing pad 201 is measured by the gaps 202 and 203, and the thickness profile is obtained as shown in FIG. 2*c*. The method of measuring the thickness of the polishing pad by the gaps 202 and 203 as above uses less time but the resulting measurement is incomplete.

Another conventional chemical mechanical polishing machine is shown in FIG. 3. The chemical mechanical polishing machine comprises a body 302, a polishing spindle 303, and a carrier 304. The polishing pad 301 is grasped by the carrier 304. The polishing pad 301 comprises an upper pad 301*a* and a lower pad 301*b*. A wafer (not shown) is situated between the upper pad 301*a* and the lower pad 301*b*. The polishing pad 301 is situated in a predetermined position in the chemical mechanical polishing machine. The polishing pad 301 is grasped by the carrier 304 before the wafer is polished.

The polishing spindle 303 moves up and down corresponding to the rough surface of the polishing pad 301. The operator must estimate the thickness of the polishing pad 301 after a period of use. The polishing pad 301 is replaced if the operator determines the thickness of the polishing pad is insufficient. The pad is used if the operator determines the thickness of the polishing pad 301 is sufficient.

Replacement of the polishing pad is decided by the operator of the chemical mechanical polishing machine, and may be performed needlessly if the thickness of the polishing pad is sufficient but judged incorrectly by the operator. Conversely, wafers may be abraded if the thickness of the polishing pad is insufficient.

SUMMARY OF THE INVENTION

Accordingly, the object of the present invention is to provide a monitoring apparatus for a polishing pad and method thereof, to monitor the condition of the polishing pad and change it precisely when needed, thereby lowering costs.

The present invention provides a monitoring apparatus for a polishing pad comprising a chemical mechanical polishing machine, a polishing pad, a measuring device, and a display device. The polishing pad is situated in a predetermined position in the chemical mechanical polishing machine. The measuring device is coupled to the chemical mechanical polishing machine to measure the thickness of the polishing pad. The measured thickness of the polishing pad is displayed on the display device.

The present invention also provides a method of monitoring the polishing pad as follows. A polishing pad is situated in a predetermined position in the chemical mechanical polishing machine. A measuring device is disposed on a carrier of the chemical mechanical polishing machine. When the carrier moves, the measuring device emits light to an interceptor. A reflection is received from the interceptor. The measuring device computes a thickness of the polishing pad based on the reflection. The wafer is polished when the thickness of the polishing pad exceeds a predetermined thickness. The polishing pad is replaced if its thickness is less than a predetermined thickness.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE INVENTION

Figure 1A:
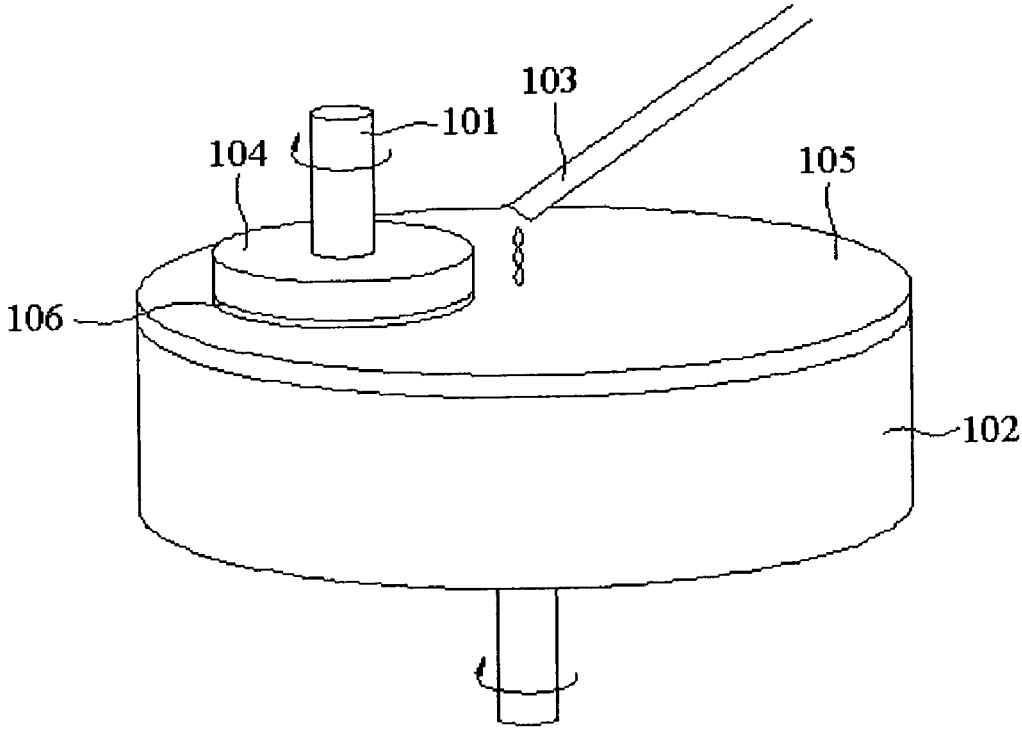
FIG. 1a ( PRIOR ART )
FIG. 1*a* depicts a conventional chemical mechanical polishing machine.
Figure 1B:
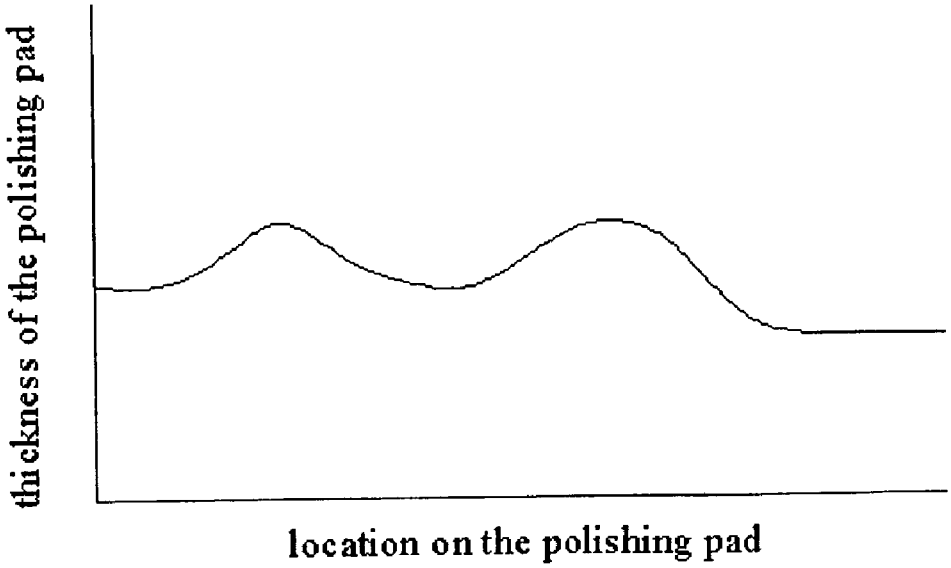
FIG. 1b( PRIOR ART )
FIG. 1*b* is a cross-section of a conventional polishing pad.
Figure 2A:
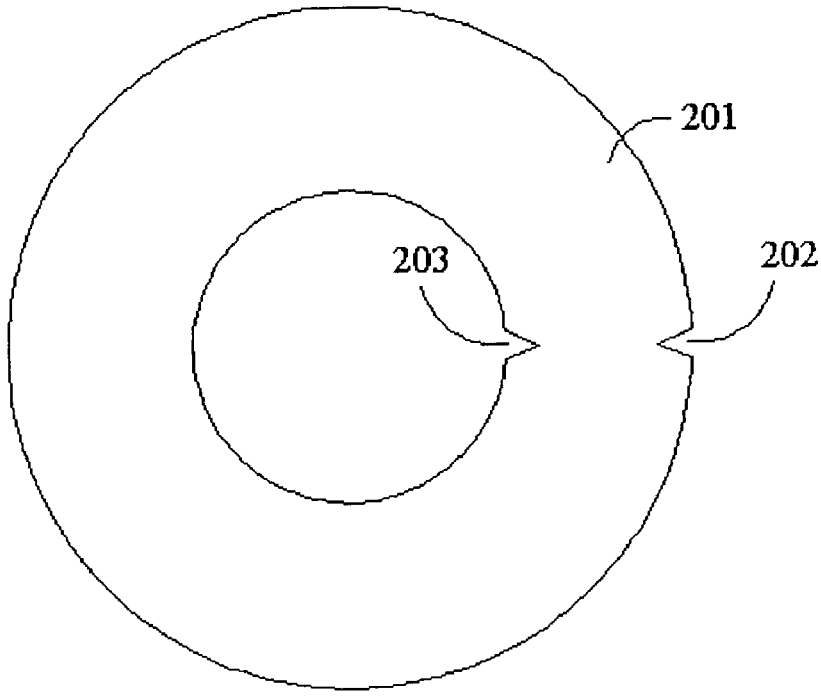
FIG. 2a( PRIOR ART )
FIGS. 2*a*–2*b* depict a conventional polishing pad.
Figure 2B:
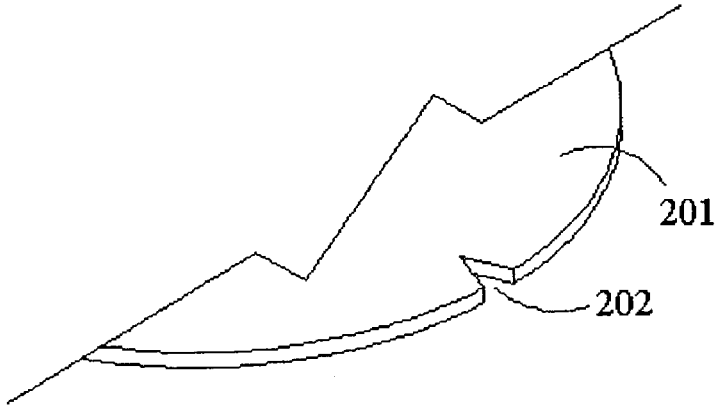
FIG. 2b( PRIOR ART )
Figure 2C:
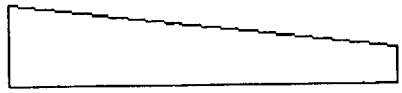
FIG. 2c( PRIOR ART )
FIG. 2*c* is a cross-section of the polishing pad in FIG. 2*b;*
Figure 3:
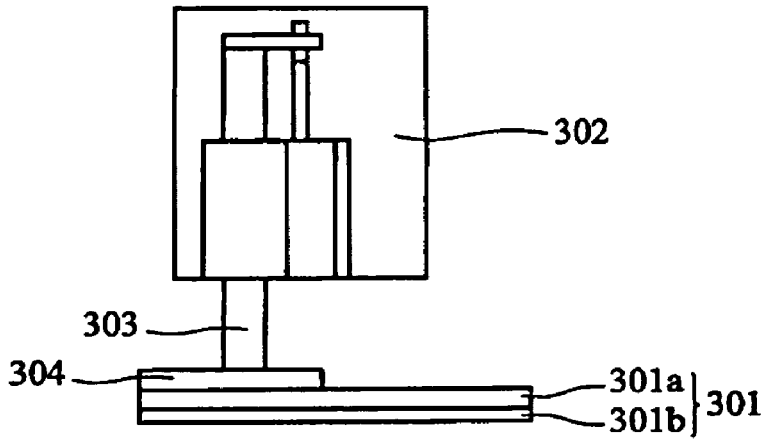
FIG. 3( PRIOR ART )
FIG. 3 depicts a conventional chemical mechanical polishing machine.
Figure 4:
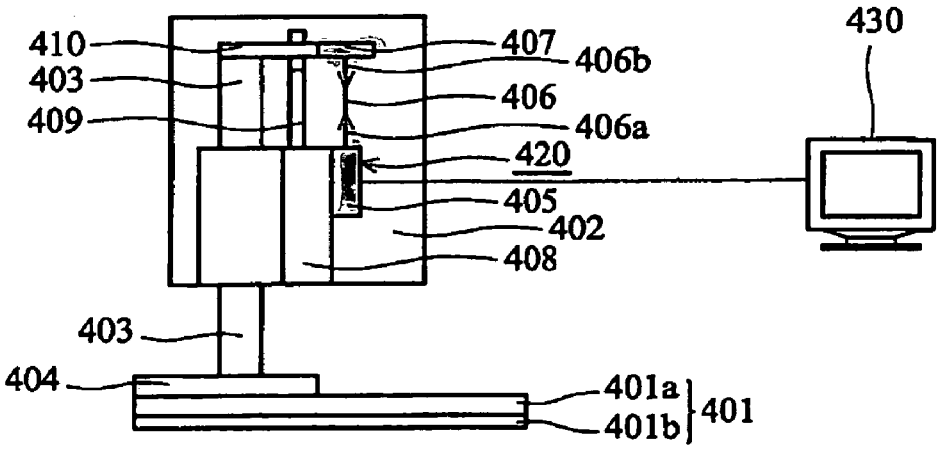
FIG. 4 depicts a chemical mechanical polishing machine of the present invention.

In FIG. 4, the monitoring apparatus for a polishing pad of the present invention is placed on a conventional chemical mechanical polishing machine, and set up without modifying the structure thereof The chemical mechanical polishing machine with a monitoring apparatus for a polishing pad comprises a body 402, a polishing spindle 403, a carrier 404, a pressure cylinder 408, a pressure cylinder spindle 409, and a fixture 410. The pressure cylinder spindle 409 is moved by the polishing spindle 403 via the fixture 410.

In addition to the above, the chemical mechanical polishing machine with the monitoring apparatus for a polishing pad comprises a measuring device 420 and a display device 430. The measuring device 420 comprises a displacement sensor 405, a light emitting device (not shown), and an interceptor 407. The light emitting device is a laser emitting device with a measuring device 420. Light 406*a* emitting device from the laser is emitted to the interceptor 407, and reflected light 406*b* to the measuring device 420. The measuring device 420 measures the thickness of the polishing pad 401.

The polishing pad 401 comprises an upper pad 401*a* and a lower pad 401*b*, between which the wafer polished is situated. The polishing pad 401 is grasped by the carrier 404, fixing the wafer. Polishing begins when the polishing pad 401 is grasped by the carrier 401. The movement of the polishing pad 401 is controlled by the polishing spindle 403, moving up and down corresponding to the rough surface of the polishing pad 401. The height of the surface of the polishing pad is detected.

The light 406*a* is emitted by the light emitting device of the displacement sensor 405, and the light 406*b* is reflected by the interceptor 407 to the displacement sensor 405.

The light 406*b* is received from the interceptor 407, and the measuring device 420 computes a thickness of the polishing pad based on the reflection. The resulting measurement appears on the display device 430.

Here, the polishing pad 401 is situated on the predetermined position on the chemical mechanical polishing machine. The wafer is situated between the two surfaces of the polishing pad 401. The polishing pad 401 is grasped by the carrier 404. The frequency of measurement of the polishing pad 401 is decided by a constant for wafer polishing or a predetermined time of polishing.

The value of the constant for wafer polishing or the predetermined time of polishing is decided by previous statistical data. For example, if the polishing pad is to be changed after 80–100 hrs or 450–500 polishings, the measurement frequency of the polishing pad is 80 hrs of use or 450 polishings.

The light of laser 406 is emitted from the laser of the displacement sensor 405 to the interceptor 407. The light of the laser 406 is intercepted by the interceptor 407, and reflected to the measuring device. The thickness of the polishing pad 401 is measured when the measuring device receives the light of the laser 406.

The thickness of the polishing pad 401 is compared with the predetermined thickness of the polishing pad. The next wafer is polished when the thickness of the polishing pad exceeds the predetermined thickness. The thickness of the polishing pad is measured after the wafer is polished. The polishing pad 401 is replaced if the thickness of the polishing pad 401 is less than the predetermined thickness.

In one case, the predetermined thickness of the polishing pad is 1.3 mm. The next wafer is polished when the thickness of the polishing pad exceeds 1.3 mm. The polishing pad is replaced when the thickness of the polishing pad is less than 1.3 mm.

In this case, the polishing pad 401 is measured after 80 hrs of use. The thickness of the polishing pad 401 is 1.7 mm, exceeding 1.3 mm, so the next wafer is polished with the polishing pad 401. The thickness of the polishing pad is measured after the wafer is polished.

In another case, the polishing pad 401 is measured after 80 hrs of use. The thickness of the polishing pad 401 is 1.27 mm, less than 1.3 mm, so the polishing pad 401 is replaced.

Figure 5:
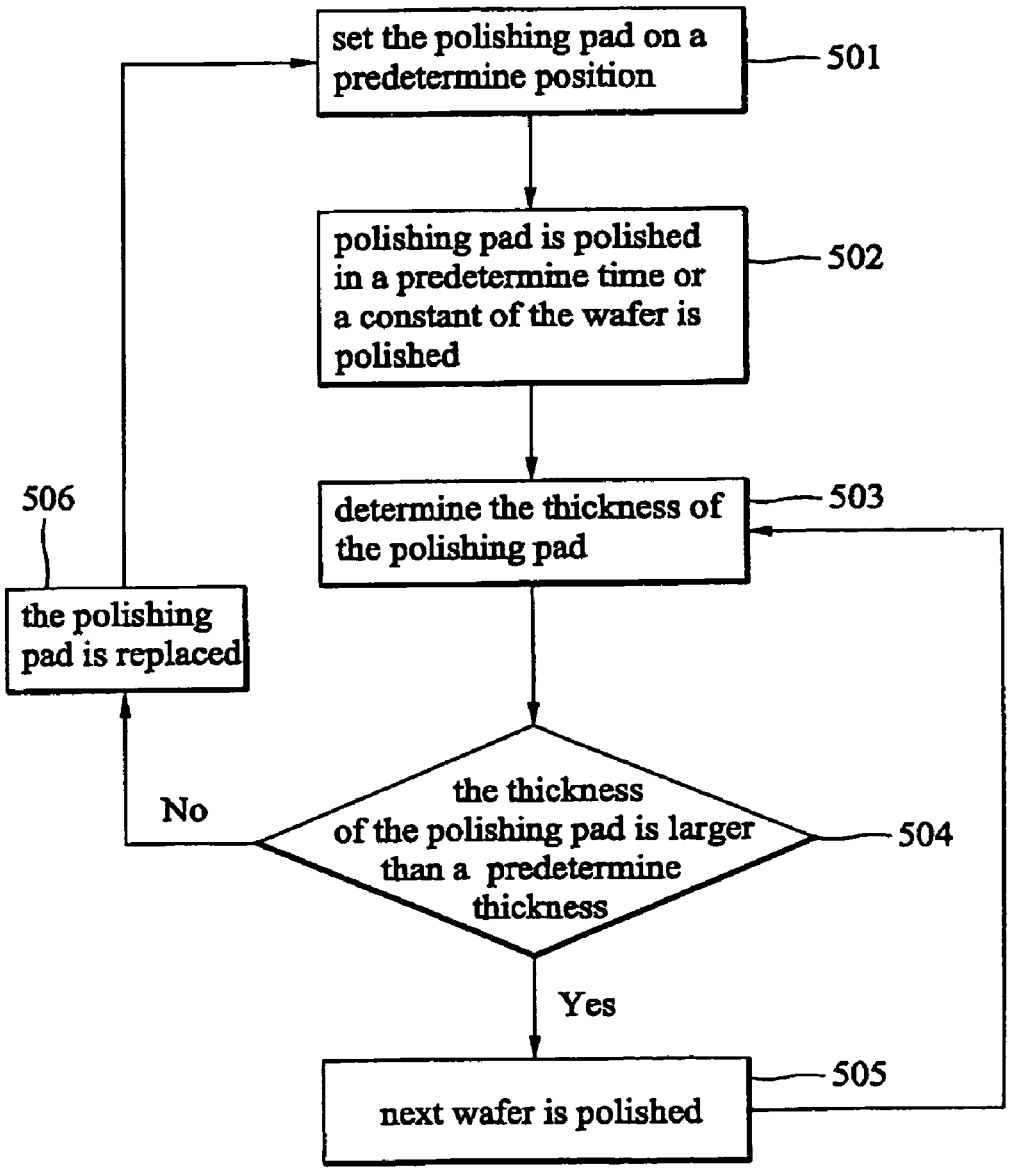
FIG. 5 is a flowchart diagram of a monitoring for thickness of a polishing pad according to the present invention.

The flowchart of pad thickness monitoring of the present invention is shown in FIG. 5.

In step 501, the polishing pad is set in a predetermined position in the chemical mechanical polishing machine. The wafer is situated between the two surfaces of the polishing pad. The polishing pad is grasped by the holder.

In step 502, the polishing pad is polished for a predetermined time.

In step 503, light is emitted to the interceptor from the light emitting device of the measuring device. The thickness of the polishing pad is measured when the light is received by the measuring device.

In step 504, when the thickness of the polishing pad exceeds a predetermined thickness, step 505 is performed.

When the thickness of the polishing pad is less than a predetermined thickness, step 506 is performed.

In step 505, the next wafer is polished when the thickness of the polishing pad exceeds the predetermined thickness. The polishing pad is measured after the wafer is polished. In this case, the thickness of the polishing pad is 1.7 mm. The next wafer is polished when the predetermined thickness of the polishing pad exceeds 1.3 mm. The polishing pad is measured after the wafer is polished.

In step 506, the polishing pad is replaced if the thickness of the polishing pad is less than the predetermined thickness. The next wafer is polished with a new polishing pad. In this case, the thickness of the polishing pad is 1.27 mm.

The thickness of the polishing pad is measured exactly with the apparatus and method of the present invention, and costs are conserved when errors in measurement are avoided thereby.

While the invention has been described by way of example and in terms of the preferred embodiments, it is to be understood that the invention is not limited to the disclosed embodiments. To the contrary, it is intended to cover various modifications and similar arrangements (as would be apparent to those skilled the art). Thus, the scope of the appended claims should be accorded the broadest interpretation so as to encompass all such modifications and similar arrangements.

What is claimed is:

1. A method of monitoring a polishing pad, comprising:

providing a chemical mechanical polishing machine with a fixture;

setting a polishing pad in a predetermined position to the fixture of the chemical mechanical polishing machine;

emitting light to an interceptor on the fixture when the carrier moves;

receipting reflected light from the interceptor;

computation of a thickness of the polishing pad based on the reflected light; and polishing a wafer when the thickness of the polishing pad exceeds a predetermined thickness.

2. The method of monitoring a polishing pad according to claim 1, further comprising changing the polishing pad when the thickness of the polishing pad is less than the predetermined thickness.

3. The method of monitoring a polishing pad according to claim 1, wherein the predetermined thickness is about 1.3 mm.

4. The method of monitoring a polishing pad according to claim 3, wherein the step of emission of light comprises radiating light from a laser emitting device.

5. The method of monitoring a polishing pad according to claim 1, wherein the fixture is position at top of a pressure cylinder spindle.

* * * * *